US011193692B2

(12) United States Patent
Delgoshaei et al.

(10) Patent No.: US 11,193,692 B2
(45) Date of Patent: Dec. 7, 2021

(54) HVAC SYSTEM PROGNOSTICS

(71) Applicant: Lennox Industries Inc., Richardson, TX (US)

(72) Inventors: Payam Delgoshaei, Addison, TX (US); Glenn William Kowald, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 94 days.

(21) Appl. No.: 16/834,226

(22) Filed: Mar. 30, 2020

(65) Prior Publication Data

US 2021/0302054 A1 Sep. 30, 2021

(51) Int. Cl.

| | |
|---|---|
| ***F24F 11/80*** | (2018.01) |
| ***F24F 11/52*** | (2018.01) |
| ***F24F 11/64*** | (2018.01) |
| ***F24F 11/38*** | (2018.01) |
| ***F24F 11/67*** | (2018.01) |
| ***F24F 110/12*** | (2018.01) |
| ***F24F 130/10*** | (2018.01) |
| ***F24F 120/10*** | (2018.01) |

(52) U.S. Cl.

CPC ..... *F24F 11/80* (2018.01); *F24F 11/38* (2018.01); *F24F 11/52* (2018.01); *F24F 11/64* (2018.01); *F24F 11/67* (2018.01); *F24F 2110/12* (2018.01); *F24F 2120/10* (2018.01); *F24F 2130/10* (2018.01)

(58) Field of Classification Search

CPC .. F24F 11/80; F24F 11/67; F24F 11/64; F24F 11/38; F24F 11/52; F24F 2120/10; F24F 2110/12; F24F 2130/10

USPC ..... 700/276

See application file for complete search history.

(56) References Cited

U.S. PATENT DOCUMENTS

| | | | | |
|---|---|---|---|---|
| 2014/0039686 | A1* | 2/2014 | Corbin | G05D 23/1923 700/276 |
| 2014/0039835 | A1* | 2/2014 | Simons | G05D 23/1917 702/183 |
| 2015/0094986 | A1* | 4/2015 | Daddis, Jr. | G01M 99/005 702/183 |
| 2017/0343228 | A1* | 11/2017 | Dyess | F24F 11/30 |

* cited by examiner

*Primary Examiner* — Jigneshkumar C Patel
(74) *Attorney, Agent, or Firm* — Baker Botts L.L.P.

(57) ABSTRACT

An HVAC system includes a controller configured to receive weather forecast information including anticipated future outdoor temperatures. Based at least in part on the weather forecast information, the controller determines that test-initiation criteria are satisfied for testing operation of the HVAC system in a test mode. In response to determining that the test-initiation criteria are satisfied, the controller determines that current weather conditions are suitable for operating the HVAC system in the test mode for a test time period. The HVAC system is operated in the test mode for the test time period. Following operation of the HVAC system in the test mode for the test time period, the controller determines whether a predefined change in an indoor air temperature is achieved. If the predefined change in the indoor air temperature is achieved, the test is passed. Otherwise, the test is failed.

20 Claims, 4 Drawing Sheets

HVAC SYSTEM PROGNOSTICS

TECHNICAL FIELD

The present disclosure relates generally to heating, ventilation, and air conditioning (HVAC) systems and methods of their use. In particular, the present disclosure relates to HVAC system prognostics.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as cooled conditioned air. Air may be heated by a heating element and returned to the enclosed as heated conditioned air.

SUMMARY OF THE DISCLOSURE

In an embodiment, a heating, ventilation, and air conditioning (HVAC) system includes a controller configured to receive weather forecast information including anticipated future outdoor temperatures. Based at least in part on the weather forecast information, the controller determines that test-initiation criteria are satisfied for testing operation of the HVAC system in the cooling mode. The test-initiation criteria correspond to an anticipated future need for operation of the HVAC system in the cooling mode within a predefined time interval. In response to determining that the test-initiation criteria are satisfied, the controller determines that current weather conditions are suitable for operating the HVAC system in the cooling mode for a test time period. In response to determining that that the current weather conditions are suitable for operating the HVAC system in the cooling mode for the test time period, the HVAC system is operated in the cooling mode for the test time period. Following operation of the HVAC system in the cooling mode for the test time period, the controller determines whether a predefined decrease in an indoor air temperature is achieved. If the predefined decrease in the indoor air temperature is achieved, the cooling test is passed. Otherwise, the cooling test failed, and an indication that the cooling test failed is provided for display.

Components of HVAC systems can fail or malfunction leading to downtimes during which desired heating and/or cooling cannot be achieved. For example, an evaporator coil may experience a loss of charge, resulting in a failure to provide desired cooling to a space (e.g., during high-temperature outdoor weather conditions). Similarly, a heating element configured to heat a flow of air may fail, resulting in an inability to provide heated air to the space (e.g., during low-temperature outdoor weather conditions). This disclosure encompasses the recognition of a previously unknown problem associated with previous technology. For instance, this disclosure encompasses the recognition that faults of HVAC components occur (e.g., or are recognized) at an increased frequency after periods of disuse (e.g., at transitions between seasons) and that maintenance providers of HVAC systems lack the resources to provide timely maintenance when many HVAC systems fail concurrently (e.g., as tends to occur at the change of season when heating or cooling is first requested after periods of disuse). For example, there are limited number of replacement parts and technicians available to repair damaged heating elements at the beginning of winter when HVAC systems are first operated in a heating mode after a period of disuse during warmer months. Similarly, there are limited resources for the timely repair of faults associated with providing cooling when cooling mode operation is first initiated when outdoor temperatures increase (e.g., following winter or at the start of summer). These previously unrecognized problems can result in extended downtimes during which desired cooling and/or heating cannot be provided while maintenance is pending.

The unconventional HVAC system described in this disclosure solves problems of previous technology, including the newly identified problems described above, by facilitating the preemptive detection and reporting of HVAC component failures prior to when these components are needed to provide desired heating or cooling. For example, a controller of the HVAC system may be configured to automatically test the performance of HVAC system in a test mode (e.g., in a cooling mode if heating is currently being provided, or vice versa) in order to identify any faults before the anticipated mode is requested (e.g., before a change of season and/or outdoor temperature). This facilitates the identification of faults or malfunctions associated with disused components before the components are needed to provide desired cooling and/or heating in the test mode. The tests described in this disclosure may be initiated based on a schedule, weather forecasts, measurements of outside temperature, and/or any other appropriate information. For instance, an anticipated outdoor temperature may be determined, based on a weather forecast, and used to select a time at which to initiate tests. In some embodiments, tests are performed when the conditioned space is unoccupied, thereby preventing unwanted heating or cooling during the test from impacting the comfort of individuals within the space.

Following completion of one or more tests, a proactive request for maintenance of the HVAC system can be provided before the anticipated mode is requested (e.g., before heating or cooling is needed). As such, embodiments of the HVAC system described in this disclosure facilitate proactive reporting of test results such that maintenance of faulty components can be performed before the components are brought into service at the change of a season or the like. The systems and methods described in this disclosure may be integrated into a practical application for improving the performance of HVAC systems by, in some embodiments, automatically initiating preemptive tests to prevent or substantially reduce downtimes during which desired heating and/or cooling cannot be provided to a space. As an example, the HVAC system described in this disclosure may facilitate testing of a heating element (e.g., a furnace or the like) before heating is requested (e.g., before outdoor temperature drops below a minimum temperature). Results of the test may be provided to a maintenance provider such that repairs can be performed proactively and heating mode operation is available once the outdoor temperature decreases below the minimum value. Similarly, components associated with operating in a cooling mode (e.g., a condensing unit, an evaporator, etc.) may be tested, and maintenance may be proactively requested, such that repairs may be performed before cooling mode operation is requested (e.g., before the outdoor temperature increases above a threshold value).

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

and

Figure 1:
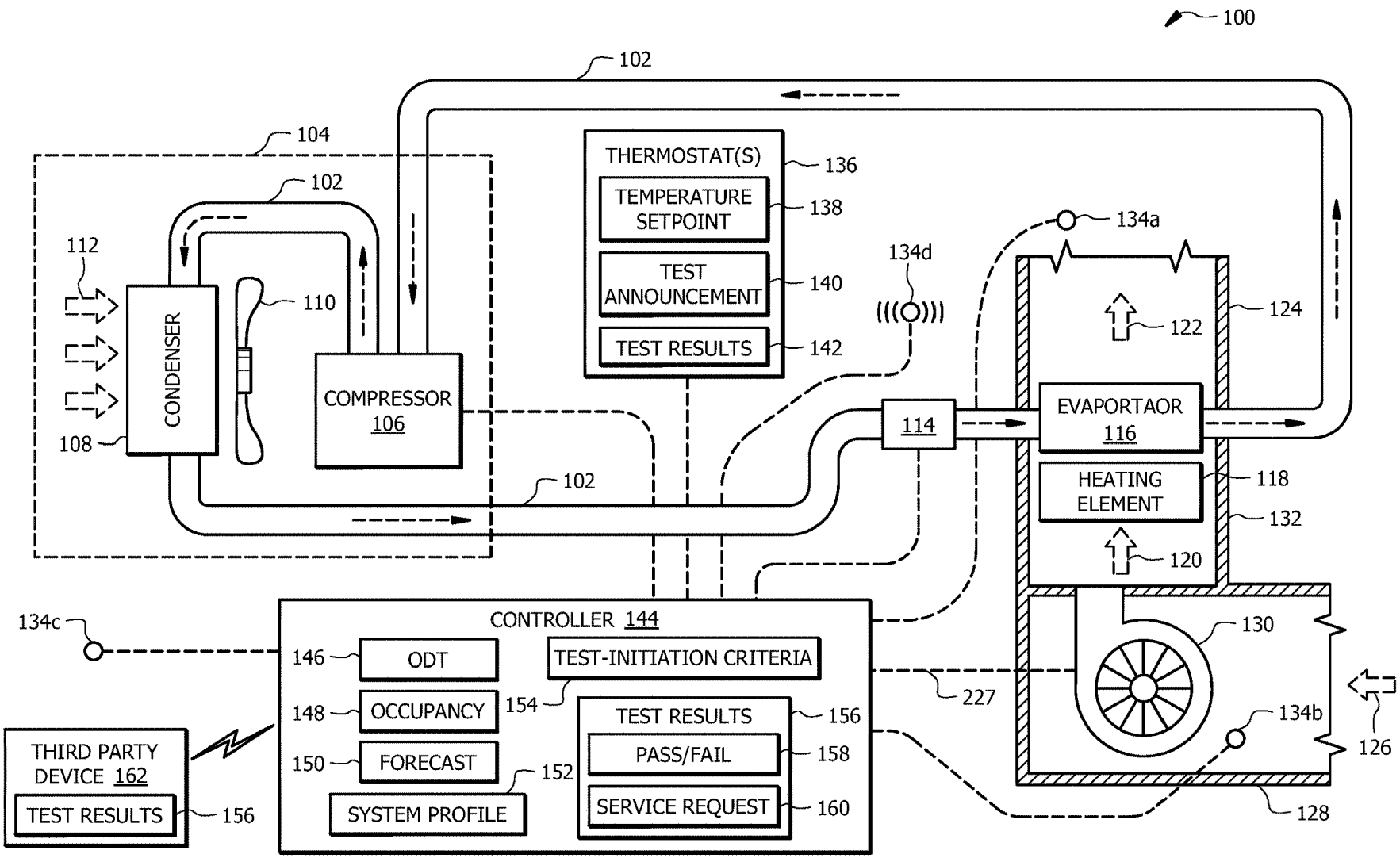
FIG. 1 is a diagram of an example HVAC system configured for seasonal prognostics of system components.
Figure 4:
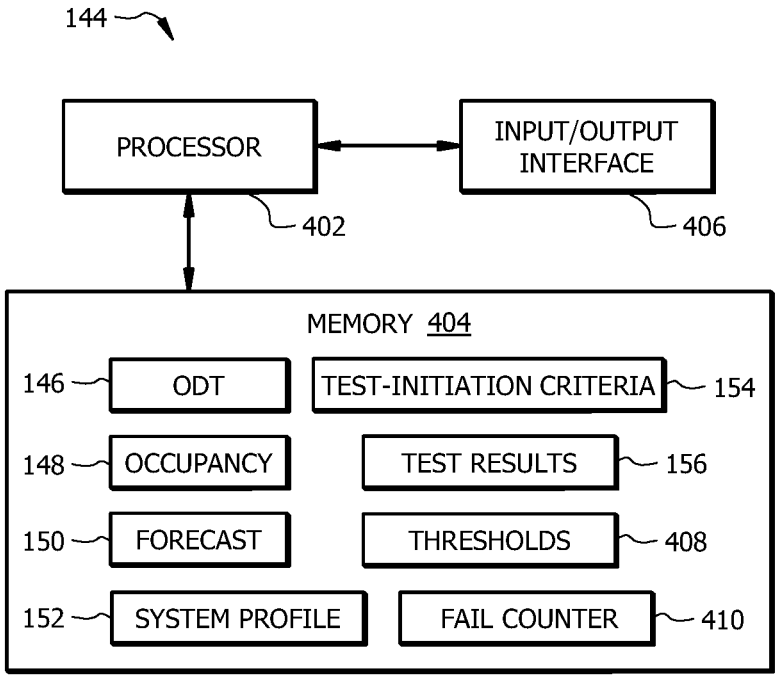

FIG. 4 is a diagram of an example controller of the HVAC system illustrated in FIG. 1.

DETAILED DESCRIPTION

Embodiments of the present disclosure and its advantages are best understood by referring to FIGS. 1 through 4 of the drawings, like numerals being used for like and corresponding parts of the various drawings.

As described above, prior to this disclosure, there was a lack of tools for reliably identifying potential system faults, particularly those associated with switching from heating to cooling mode operation (e.g., when the outdoor temperature increases) and from cooling to heating mode operation (e.g., when the outdoor temperature decreases). As described in greater detail below with respect to FIGS. 1-4, an HVAC system may be configured to automatically test an anticipated operating mode such that maintenance can be proactively requested if needed, thereby overcoming limitations of previous technology. For example, the HVAC system described in this disclosure may facilitate testing of a heating element (e.g., a furnace or the like) before heating is requested (e.g., before outdoor temperature drops below a minimum temperature). Results of the test may be provided to a maintenance provider such that repairs can be performed proactively and heating mode operation is available once the outdoor temperature decreases below the minimum value. Similarly, components associated with operating in a cooling mode (e.g., a condensing unit, an evaporator, etc.) may be tested, and maintenance may be proactively requested, such that repairs may be performed before cooling mode operation is requested (e.g., before the outdoor temperature increases above a threshold value).

HVAC System

FIG. 1 is a schematic diagram of an example HVAC system 100 configured to perform system prognostics (i.e., to determine anticipated failures of the HVAC system 100 associated with switching from heating to cooling mode operation and/or vice versa). The HVAC system 100 conditions air for delivery to a space. The space may be, for example, a room, a house, an office building, a warehouse, or the like. In some embodiments, the HVAC system 100 is a rooftop unit (RTU) that is positioned on the roof of a building and conditioned air 122 is delivered to the interior of the building. In other embodiments, portion(s) of the HVAC system 100 may be located within the building and portion(s) outside the building. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, at least one condensing unit 104, an expansion device 114, an evaporator 116, a heating element 118, a blower 130, one or more thermostats 136, and a controller 144. The controller 144 of the HVAC system 100 is generally configured to determine whether test-initiation criteria 154 are satisfied and, if the criteria 154 are satisfied, automatically test the HVAC system 100 in an anticipated operating mode (e.g., a cooling mode if cooling is anticipated to be requested in the future or a heating mode if heating is anticipated to be requested in the future). Results 158 of the test(s) may be automatically provided to a third party 162 such that any malfunctioning components of the HVAC system 100 may be proactively serviced.

The working-fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

The condensing unit 104 includes a compressor 106, a condenser 108, and a fan 110. In some embodiments, the condensing unit 104 is an outdoor unit while other components of the HVAC system 100 may be located indoors. The compressor 106 is coupled to the working-fluid conduit subsystem 102 and compresses (i.e., increases the pressure of) the working fluid. The compressor 106 of condensing unit 104 may be a single-speed, variable-speed, multiple stage compressor. A variable-speed compressor is generally configured to operate at different speeds to increase the pressure of the working fluid to keep the working fluid moving along the working-fluid conduit subsystem 102. In the variable-speed compressor configuration, the speed of compressor 106 can be modified to adjust the cooling capacity of the HVAC system 100. Meanwhile, in the multi-stage compressor configuration, one or more compressors can be turned on or off to adjust the cooling capacity of the HVAC system 100.

The compressor 106 is in signal communication with the controller 144 using wired and/or wireless connection. The controller 144 provides commands or signals to control operation of the compressor 106 and/or receives signals from the compressor 106 corresponding to a status of the compressor 106. In some embodiments, the compressor 106 may be configured to receive signals from controller 144 to control its operation but cannot provide information regarding its status (e.g., the operational health of the compressor 106) to the controller 144. For example, the controller 144 may transmit signals to adjust compressor speed. The controller 144 may operate the compressor 106 in different modes corresponding, for example, to a user requested mode, to load conditions (e.g., the amount of cooling or heating required by the HVAC system 100), and/or whether a test is indicated by the controller 144, as described in greater detail below. The controller 144 is described in greater detail below with respect to FIG. 4.

The condenser 108 is configured to facilitate movement of the working fluid through the working-fluid conduit subsystem 102. The condenser 108 is generally located downstream of the compressor 106 and is configured, when the HVAC system 100 is operating in a cooling mode, to remove heat from the working fluid. The fan 110 is configured to move air 112 across the condenser 108. For example, the fan 110 may be configured to blow outside air through the condenser 108 to help cool the working fluid flowing therethrough. The compressed, cooled working fluid flows from the condenser 108 toward the expansion device 114.

The expansion device 114 is coupled to the working-fluid conduit subsystem 102 downstream of the condenser 108 and is configured to remove pressure from the working fluid. In this way, the working fluid is delivered to the evaporator 116 and receives heat from airflow 120 to produce a conditioned airflow 122 that is delivered by a duct subsystem 124 to the conditioned space. In general, the expansion device 114 may be a valve such as an expansion valve or a flow control valve (e.g., a thermostatic expansion valve) or any other suitable valve for removing pressure from the working fluid while, optionally, providing control of the rate of flow of the working fluid. The expansion device 114 may be in communication with the controller 144 (e.g., via wired and/or wireless communication) to receive control signals for opening and/or closing associated valves and/or provide flow measurement signals corresponding to the rate of working fluid through the working-fluid conduit subsystem 102. In some embodiments, the expansion device 114 cannot provide information regarding its status (e.g., the operational health of the expansion device 114) to the controller 144.

The evaporator 116 is generally any heat exchanger configured to provide heat transfer between air flowing through (or across) the evaporator 116 (i.e., air contacting an outer surface of one or more coils of the evaporator 116) and working fluid passing through the interior of the evaporator 116, when the HVAC system 100 is operated in the cooling mode. The evaporator 116 may include one or more circuits. The evaporator 116 is fluidically connected to the compressor 106, such that working fluid generally flows from the evaporator 116 to the condensing unit 104. A portion of the HVAC system 100 is configured to move air 120 across the evaporator 116 and out of the duct sub-system 124 as conditioned air 122.

The heating element 118 is generally any device for heating the flow of air 120 and providing heated air 122 to the conditioned space, when the HVAC system 100 is configured to operate in a heating mode. For example, the heating element 118 may be a furnace, an electrical heater (e.g., comprising one or more resistive elements), or a heat pump configured to heat the flow of air 120 passing therethrough. The heating element 118 may be in communication with the controller 144 (e.g., via wired and/or wireless communication) to receive control signals for activating the heating element 118 to heat the flow of air 120, when the HVAC system 100 is operated in a heating mode. However, the heating element 118 may not provide information regarding its status (e.g., the operational health of the heating element 118) to the controller 144. Generally, when the HVAC system 100 is operated in the heating mode, the heating element 118 and blower 130 are turned on such that the flow of air 120 is provided across and heated by the heating element 118. When the HVAC system 100 is operated in a cooling mode, the heating element 118 is generally turned off (i.e., such that the flow of air 120 is not heated).

Return air 126, which may be air returning from the building, air from outside, or some combination, is pulled into a return duct 128. A suction side of the blower 130 pulls the return air 126. The blower 130 discharges air 120 into a duct 132 such that air 120 crosses the evaporator 116 and/or heating element 118 to produce conditioned air 122. The blower 130 is any mechanism for providing a flow of air through the HVAC system 100. For example, the blower 130 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower. The blower 130 is in signal communication with the controller 144 using any suitable type of wired and/or wireless connection. The controller 144 is configured to provide commands and/or signals to the blower 130 to control its operation.

The HVAC system 100 includes one or more sensors 134*a-d* in signal communication with controller 144. Sensors 134*a-d* may include any suitable type of sensor for measuring air temperature, relative humidity, motion, and/or any other properties associated with a conditioned space (e.g. a room or building). The sensors 134*a-c* may be positioned anywhere within the conditioned space, the HVAC system 100, and/or the surrounding environment. For example, as shown in the illustrative example of FIG. 1, the HVAC system 100 may include a sensor 134*a* positioned and configured to measure a discharge air temperature (e.g., of airflow 122), a temperature of the conditioned space, and/or a relative humidity of the conditioned space. Example sensor 134*b* is positioned and configured to measure a return air temperature (e.g., of airflow 126). Example sensor 134*c* may be positioned and configured to measure an outdoor air temperature (ODT) 146. Example sensor 134*d* is positioned and configured to detect motion in the conditioned space. Detected motion may be used, at least in part, to determine an occupancy 148 of the conditioned space. Signals corresponding to the properties measured by sensors 134*a-d* may be provided to the controller 144. In other examples, the HVAC system 100 may include other sensors (not shown for clarity and conciseness) positioned and configured to measure any other suitable property associated with operation of the HVAC system 100 (e.g., the temperature and/or relative humidity of air at one or more locations within the conditioned space and/or an outdoor relative humidity).

The HVAC system 100 includes one or more thermostats 136, for example, located within the conditioned space (e.g. a room or building). The thermostat(s) 136 are generally in signal communication with the controller 144 using any suitable type of wired and/or wireless connection. In some embodiments, one or more functions of the controller 144 may be performed by the thermostat(s) 136. For example, the thermostat 136 may include the controller 144. The thermostat(s) 136 may be include one or more single-stage thermostats, one or more multi-stage thermostat, or any suitable type of thermostat(s). The thermostat(s) 136 are configured to allow a user to input a desired temperature or temperature setpoint 138 for the conditioned space and/or for a designated space or zone, such as a room, in the conditioned space.

The controller 144 may use information from the thermostat 136 such as the temperature setpoint 138 for controlling the compressor 106, the blower 130, and the fan 110 (e.g., for operation in a cooling mode) and/or of the heating element 118 and blower 130 (e.g., for operation in a heating mode). In some embodiments, a thermostat 136 includes a user interface and/or display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for display of a test announcement 140 (e.g., indicating that a test is being and/or will be performed for the HVAC system 100), test results 158 for any test(s) performed, and/or any other messages related to the status and/or operation of the HVAC system 100.

As described in greater detail below, the controller 144 is configured to determine whether test-initiation criteria 154 are satisfied for the HVAC system 100. This determination may be based at least in part on measured outdoor temperatures 146, an occupancy 148 of the conditioned space, and/or received weather forecast information 150. The outdoor temperatures 146 may be measured with sensor 134*c*. The occupancy 148 of the conditioned space may be determined based on information from sensor 134*d*. For example, if no motion is detected in the space for at least a minimum period of time, the space may be considered unoccupied. The occupancy 148 may also or alternatively be based on an established schedule. For example, a user may input known times when the space will be unoccupied (e.g., during the night for a business location or during work hours for a residential location). The occupancy 148 may also or alternatively be determined using location information for known occupants of the space. For instance, if locations (e.g., provided by devices of known occupants of the space) indicate that the users are not within the space, then the occupancy 148 for the space may be zero.

Examples of test-initiation criteria 154 are provided in greater detail below with respect to FIG. 2A. In brief, the test-initiation criteria 154 may include a requirement that an anticipated outdoor temperature will soon (e.g., within about three weeks or so) either (1) fall below a first threshold value (e.g., of about 65° F.) for testing a heating mode or (2) exceed a second threshold value (e.g., of about 70° F.) for testing a cooling mode. As also described below with respect to FIG. 2A, in some embodiments, the test-initiation criteria 154 may be determined, at least in part, based on a system profile 152, which is established, by the controller 144, over time for the HVAC system 100. The system profile 152 generally reflects the history of usage of the HVAC system 100 (e.g., at which times and/or under which conditions the HVAC system 100 is switched between operation in a heating mode and a cooling mode). The controller 144 is described in greater detail below with respect to FIG. 4.

As described above, in certain embodiments, connections between various components of the HVAC system 100 are wired. For example, conventional cable and contacts may be used to couple the controller 144 to the various components of the HVAC system 100, including, the compressor 106, the fan 110, the expansion device 114, heating element 118, sensors 134*a-d*, blower 130, and thermostat(s) 136. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 144 to other components of the HVAC system 100.

In an example operation of HVAC system 100, the HVAC system 100 starts up to operate in a cooling mode. For example, in response to the indoor temperature exceeding the temperature setpoint 138, the controller 144 may cause the compressor 106, the fan 110, and the blower 130 to turn on to start up the HVAC system 100. During operation of the HVAC system 100, the controller 144 receives information related to the outdoor temperature 146, the occupancy 148 of the conditioned space, and/or the weather forecast 150. This information may be compared to the test-initiation criteria 154 to determine whether a test of heating mode operation should be performed.

Figure 2A:
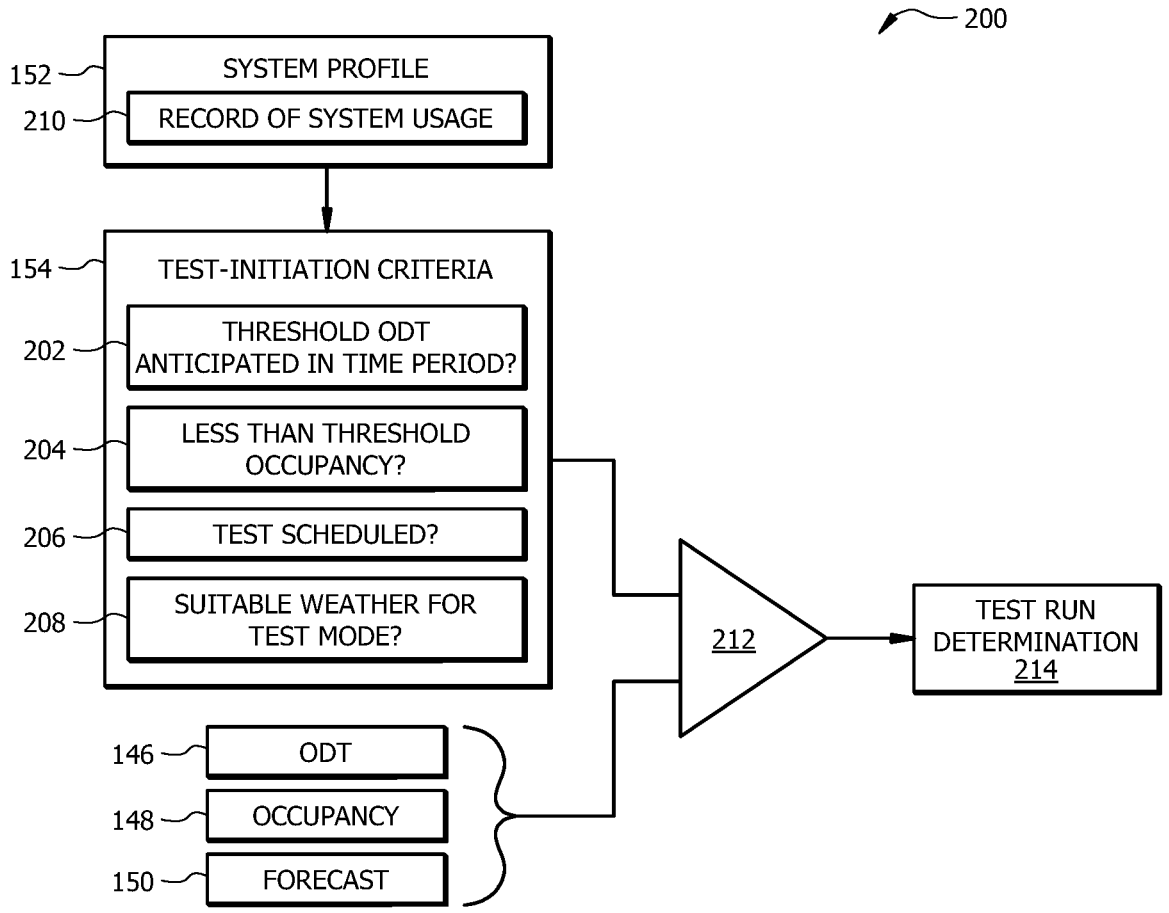
FIG. 2A is a diagram illustrating the determination and use of test-initiation criteria during operation of the HVAC system of FIG. 1.

As an example, FIG. 2A is a diagram 200 illustrating the determination of whether test-initiation criteria 154 are satisfied for operating in a test mode. In this example, the test-initiation criteria 154 include criteria 202, 204, 206, and 208. A comparator 212 may compare the test-initiation criteria to current values of the outdoor temperature 146, the occupancy 148, and/or the weather forecast information 150 to make a determination 214 of whether a test should be initiated. Generally, one or more of the criteria 202, 204, 206, 208 must be satisfied in order to determine a positive test-run determination 214. The first criterion 202 is that a threshold outdoor temperature is anticipated in a predefined time interval. The first example criterion 202 may, for example, be that the forecast 150 and/or the outdoor temperature 146 indicate that a threshold outdoor temperature will be reached that would cause a user to request for the HVAC system 100 to be operated in the heating mode. The second example criterion 204 is a requirement that the occupancy 148 is less than a threshold occupancy. For example, the second criterion 204 may indicate that the occupancy 148 of the conditioned space should be zero in order for the test to be run (i.e., in order for the test-run determination 214 to be positive). The third example criterion 206 may be that a test is currently scheduled (e.g., based on a predetermined schedule for the HVAC system 100 (e.g., as provided by a user or administrator of the HVAC system 100). The fourth example criterion 208 is that the current outdoor conditions (e.g., outdoor temperature 146) are suitable for operating the HVAC system 100 in the test mode. For example, in order for the fourth criterion 208 to be satisfied, the outdoor temperature 146 may have to be less than a threshold temperature for operating heating element 118 of FIG. 1.

In some embodiments, the controller 144 of FIG. 1 is further configured to maintain a record 210 of the usage of system 100 and use this information to determine the system profile 152. The system profile 152 may be used to determine and/or update the test-initiation criteria 154. For instance, the system profile 152 may indicate an appropriate test schedule for the HVAC system 100 based on the usage record 210, which may include dates on which the system 100 is switched between heating and cooling modes. The schedule may indicate to test the heating mode on a date (i.e., month and day of year) that is about three weeks before the average date on which the HVAC system 100 has historically been changed from operating in the cooling mode to operating in the heating mode. This information may be used to determine an appropriate schedule criterion 206 for the HVAC system 100. The usage record 210 may also or alternatively include an average outdoor temperature at or above which a the HVAC system 100 is typically switched between cooling and heating modes. This information may be used to determine the threshold temperature of the first criterion 202.

Returning to FIG. 1, if the test-initiation criteria 154 are satisfied (e.g., based on determination 214 of FIG. 2A), the controller 144 causes the HVAC system 100 to operate in the heating mode for a period of time (e.g., for 15 minutes). Prior to operating in the heating mode, the controller 144 may cause display of the test announcement 140 on an interface of a thermostat 136 coupled to the controller. In some embodiments, the controller 144 may delay operating in the heating mode until a confirmation is received from a user that operation in the heating mode is acceptable. The user may also or alternatively input commands to delay the test until a more appropriate or convenient time or to cancel the test. Operating in the heating mode may correspond to stopping operation of the compressor 106, and fan 110 and starting operation of the heating element 118 (i.e., with the blower 130 still running). The HVAC system 100 is then operated in the heating mode for the period of time (e.g., of about 15 minutes) and results 156 are determined.

Figure 2B:
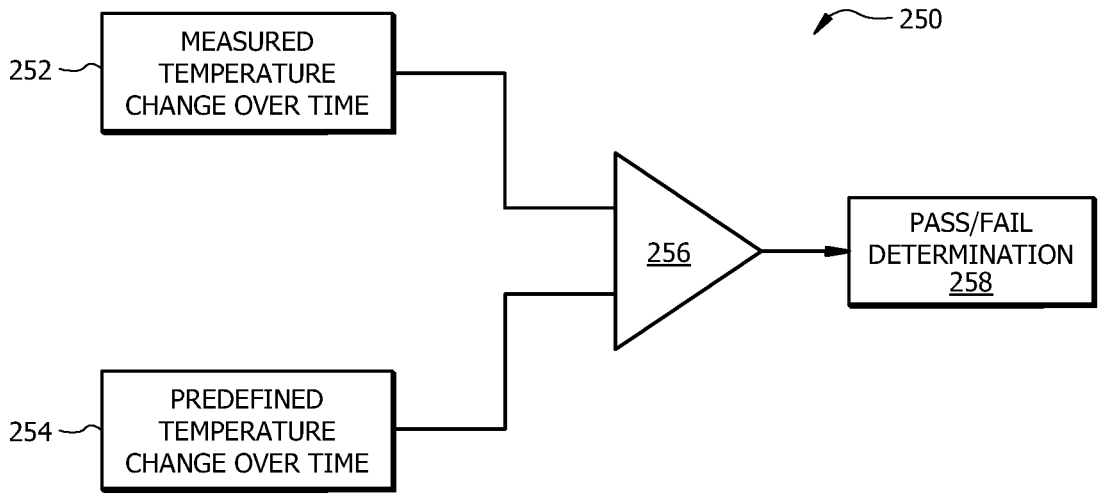
FIG. 2B is a diagram illustrating the determination of test results during testing of the HVAC system of FIG. 1.

FIG. 2B is a diagram 250 illustrating the determination of the pass/fail indication 158 of the test results 156. In this example, whether the test has passed or failed is determined by comparing (e.g., using comparator 256) a measured temperature change 252 to a predefined temperature change 254 associated with passing the test. The measured temperature change 252 may correspond to a difference between a temperature measured at an initial and a final time point, a slope of a temperature change during the test time period, or the like. If the temperature change 252 is less than the predefined temperature change 254, the determination 258 indicates that the test is failed. For a test of the heating mode, a failure to achieve the predefined temperature change 254 may indicate, for example, that the heating element 118 and/or the blower 130 are not functioning properly. Otherwise, if the measured temperature change 252 is not less than the predefined temperature change 254, the determination 258 indicates that the test is passed.

Returning to FIG. 1, the results 156 include a pass/fail indication 158 of whether the test was passed or failed and may include a maintenance request 160 associated with a failed test. For instance, the maintenance request 160 associated with a failed heating test may include a request to service the heating element 118 and/or the blower 130 of the HVAC system 100. As illustrated in FIG. 1, the results 156 (e.g., or a subset of the results, such as the request 160) may be automatically provided to a third party 162 (e.g., a maintenance provider). This may facilitate proactive repairs of the HVAC system 100, such that when the heating mode is needed (as is anticipated in the relatively near future), the HVAC system 100 is functioning properly and there is limited or no downtime during which desired heating is not available.

In another example operation of the HVAC system 100, the HVAC system 100 starts up to operate in a heating mode. For example, in response to the indoor temperature falling below the temperature setpoint 138, the controller 144 may cause the heating element 118 and the blower 130 to turn on to start up the HVAC system 100. During operation of the HVAC system 100, the controller 144 receives information related to the outdoor temperature 146, the occupancy 148 of the conditioned space, and the weather forecast 150. This information may be compared to the test-initiation criteria 154 to determine whether a test of cooling mode operation should be performed.

Referring to diagram 200 of FIG. 2A, different test-initiation criteria 154 may be used to determine whether to test operation of the HVAC system 100 in the cooling mode. For instance, the first criterion 202 may be that the forecast 150 and/or the outdoor temperature data 146 indicate that a threshold outdoor temperature (e.g., a threshold of thresholds 408 of FIG. 4) will be reached (or exceeded) within a predefined time interval (e.g., of about three weeks). The occupancy criterion 204 for testing the cooling mode may be the same as those for the heating mode, described above. Generally, the occupancy criterion 204 prevent testing from being performed during times which would cause discomfort to occupants in the space (e.g., to prevent cooling when heating is desired). The schedule criterion 206 may be similar to those described above for testing operation in the heating mode and may require that a test is currently scheduled (e.g., based on a predetermined schedule for the HVAC system 100). The fourth criterion 208 for testing cooling mode operation may be a requirement that the current outdoor conditions are suitable for operating the HVAC system 100 in the cooling mode. For example, the outdoor temperature 146 may have to be at least a minimum temperature that is appropriate for safely operating the condensing unit 104 of FIG. 1 in order for the fourth criterion 208 to be satisfied. As described above with respect to testing operation in the heating mode, the system profile 152 may be used to determine and/or update the test-initiation criteria 154.

Referring to FIG. 1, if the test-initiation criteria 154 are satisfied (e.g., based on determination 214 of FIG. 2A), the controller 144 causes the HVAC system 100 to operate in the cooling mode for a period of time (e.g., for 15 minutes). Operating in the cooling mode may correspond to stopping operation of the heating element 118 and starting operation of the compressor 106 and fan 110. The HVAC system 100 is then operated in the cooling mode for the period of time and test results 156 are determined. Prior to operating in the cooling mode, the controller 144 may cause display of the test announcement 140 on an interface of a thermostat 136 coupled to the controller. In some embodiments, the controller 144 may delay operating in the cooling mode until a confirmation is received from a user that operation in the cooling mode is acceptable. The user may also or alternatively input commands to delay the test until a more appropriate or convenient time or to cancel the test.

The results 156 include a pass/fail indication 158 of whether the test was passed or failed and may include a maintenance request 160 associated with the failed test. The results 156 may be determined as described above with respect to FIG. 2B. For instance, the maintenance request 160 associated with a failed cooling test may include a request to service the compressor 106, fan 110, and/or the blower 130 of the HVAC system 100. The request 160 may further include an indication that the system 100 should be recharged and/or that a possible source of a leak of working fluid should be identified. As illustrated in FIG. 1, the results 156 (e.g., or a subset of the results, such as the request 160) may be automatically provided to a third party 162 (e.g., a maintenance provider). This may facilitate proactive repairs of the HVAC system 100, such that when the cooling mode is needed (as is anticipated in the relatively near future), the HVAC system 100 is functioning properly and there is limited or no downtime during which desired cooling is not available.

Example Method of Operation

Figure 3:
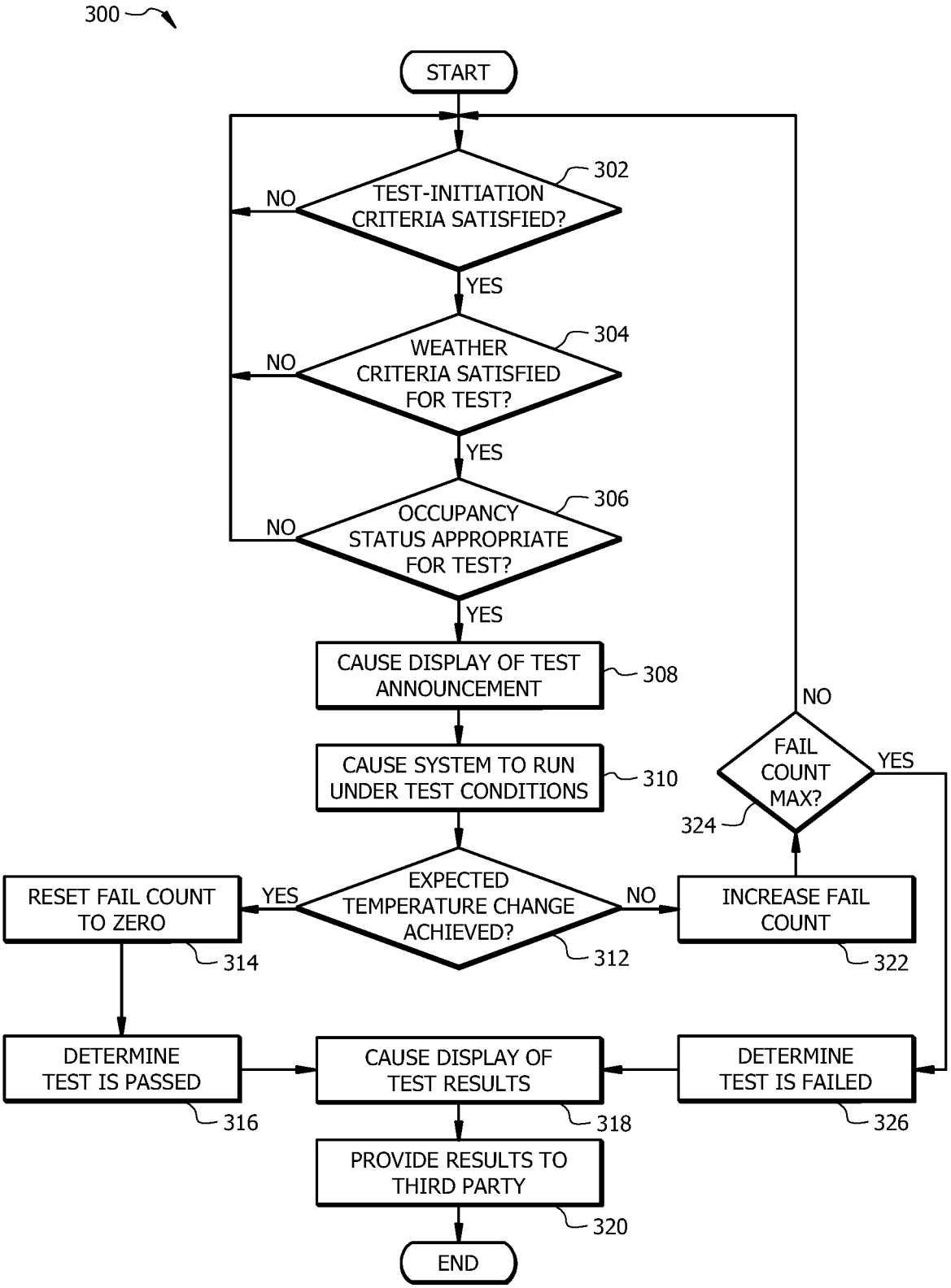
FIG. 3 is a flowchart of an example method of seasonal system prognostics.

FIG. 3 is a flowchart illustrating an example method 300 of system prognostics for the HVAC system 100 illustrated in FIG. 1. Method 300 generally facilitates the detection of system faults associated with an operating mode that is anticipated to be needed in the relatively near future for the HVAC system 100. For instance, method 300 facilitates testing of heating mode when the HVAC system is currently operated in a cooling mode (and vice versa). The method 300 may begin at step 302 where the controller 144 determines whether test-initiation criteria 154 are satisfied for the HVAC system 100. The test-initiation criteria 154 generally correspond to an anticipated future need for operation of the HVAC system 100 in an alternative mode (e.g., a cooling mode if the system 100 is currently operated in the heating mode, and vice versa) within a predefined time interval (e.g., about three weeks or so). For instance, for testing cooling mode operation, the test-criteria 154 may be determined, for example, by receiving the weather forecast 150 and determining, based on the weather forecast 150, that the outdoor temperature is anticipated to exceed a threshold value (e.g., of about 70° F.) within the predefined time interval. For testing heating mode operation, the test-criteria 154 may be determined, for example, by receiving the weather forecast 150 and determining, based on the weather forecast 150, that the outdoor temperature is anticipated to be less than a threshold value (e.g., of about 65° F.) within the predefined time interval.

If the test-initiation criteria 154 are satisfied, at step 302, the controller 144 proceeds to step 304. At step 304, the controller 144 determines whether current weather conditions are suitable for operating the HVAC system 100 in the test mode for a test time period (e.g., of about 15 minutes). The determination at step 304 may be based on whether the criterion 208 of FIG. 2A are satisfied based on one or more of the weather forecast 150 and measurements of outdoor temperature 146. For example, for the cooling test mode, the controller 144 may determine whether a current outdoor temperature 146 is greater than a minimum temperature. In order for the weather conditions to be suitable for the cooling test mode, the outdoor temperature 146 should be greater than the minimum temperature (e.g., because the condensing unit 104 may not operate properly and/or may be damaged if operated in a cold environment). For the heating test mode, the controller 144 may determine whether a current outdoor temperature 146 is less than a maximum temperature. In order for the weather conditions to be suitable for the heating test mode, the outdoor temperature 146 should be less than the maximum temperature (e.g., because it may be undesirable to operate the heating element 118 and/or other associated components of the HVAC system 100 in an excessively warm environment). If the weather conditions (e.g., the current outdoor temperature 146) are determined to be suitable for operation in the test mode, at step 304, the controller 144 may proceed to step 306. Otherwise, the controller 144 returns to the start of method 300.

At step 306, the controller 144 determines whether the occupancy 148 of the conditioned space is appropriate for operating in the test mode. As described above, the occupancy 148 of the conditioned space may be determined based on information from sensor 134*d*. For example, if no motion is detected in the space for at least a minimum period of time (e.g., of about 15 minutes), the space may be considered unoccupied. The occupancy 148 may also or alternatively be based on an established schedule. For example, a user may input known times when the space will be unoccupied (e.g., during the night for a business location or during work hours for a residential location). The occupancy 148 may also or alternatively be determined using location information for known occupants of the space. For instance, if locations (e.g., provided by devices of known occupants of the space) indicate that the users are not within the space, then the occupancy 148 for the space may be zero. For example, in order for the occupancy 148 to be suitable for operating in the test mode, the occupancy 148 may need to be less than a threshold value. In some embodiments, the occupancy 148 should be zero in order to operate in the test mode, thereby preventing any discomfort to occupants of the space during operation in the test mode. If the occupancy 148 is determined to be suitable for operation in the test mode, at step 306, the controller 144 proceeds to step 308. Otherwise, the controller 144 returns to the start of method 300.

At step 308, the controller 144 may cause display of the test announcement 140. For example, as described above, the controller 144 may cause display of the test announcement 140 on an interface of a thermostat 136 coupled to the controller 144. In some embodiments, the controller 144 may postpone operating in the test mode (at step 310, described below) until a confirmation is received from a user that operation in the test mode is acceptable. The user may also or alternatively input commands to delay the test until a more appropriate or convenient time or to cancel the test. The test announcement 140 may be displayed throughout operation in the test mode at step 310 described below (e.g., such that users are informed that normal operation is briefly unavailable while the test is in progress).

At step 310, the controller 144 causes the HVAC system 100 to operate in the test mode for a period of time (e.g., of about 15 minutes). As an example, the controller 144 causes the HVAC system 100 to operate in a heating test mode by stopping operation of the compressor 106 and fan 110 (e.g., if the HVAC system 100 was previously operating in the cooling mode) and starting operation of the heating element 118. The controller 144 may cause the HVAC system 100 to operate in the cooling test mode by starting operation of the compressor 106 and fan 110 and stopping operation of the heating element 118 (e.g., if the heating element was previously active in heating mode operation). The blower 130 is generally active during operation in both the heating and cooling test modes. The HVAC system 100 is then operated in the test mode for the period of time, and the temperature of the conditioned space is monitored during this period of time (e.g., to determine the temperature change 252 of FIG. 2B).

At step 312, the controller 144 determines whether a predefined temperature change is achieved. For instance, as described above with respect to FIG. 2B, a measured temperature change 252 during operation in the test mode at step 310 may be compared to a predefined temperature change 254 associated with passing the test. The measured temperature change 252 may correspond to a difference between a temperature measured at an initial and a final time point during test mode operation at step 310, a slope of a temperature change during the test mode operation at step 310, or the like. If the temperature change 252 is less than the predefined temperature change 254, the predefined temperature change is not achieved at step 312. Otherwise, if the measured temperature change 252 is not less than the predefined temperature change 254, the predefined temperature change is achieved at step 312. If the predefined temperature change 254 is achieved, the controller 144 proceeds to step 314. Otherwise, the controller 144 proceeds to step 322.

At step 314, the controller 144 may reset a counter of the number of failed test attempts (see description of step 322 and 324 below) to zero. In some embodiments, a fail count (e.g., using the fail counter 410 described with respect to FIG. 4 below) is maintained to further improve the reliability of the system tests described in this disclosure by ensuring that spurious results (e.g., caused by transient sensor errors or the like) from a single test do not result in false-positive reporting of system faults. Instead, in some embodiments (e.g., as described below with respect to steps 322 and 324), a minimum number of failed tests must be determined before a failed test is identified.

At step 316, the controller 144 determines that the test is passed. For example, the controller 144 may determine test results 156 with a passing indication 158 and without a maintenance request 160. At step 318, the test results 156 may be displayed on an interface of the thermostat 136. At step 320, the test results 156 may be provided to the third party 162. As such, even when the test results 156 do not indicate that service is needed, the third party 162 may still receive the results 156, thereby allowing the third party 162 to maintain a record of the performance of the HVAC system 100. This record may be useful for improving maintenance to the HVAC system 100 in the future (e.g., by enabling technicians to more effectively diagnose system faults based on past performance of the system 100).

As described above, if the predefined temperature change (e.g., temperature change 254 of FIG. 2B) is not achieved at step 312, the controller 144 proceeds to step 322. At step 322, the controller 144 increases the fail count for the HVAC system 100 (e.g., by increasing a count of the fail counter 410 of FIG. 4). At step 324, the controller 144 determines whether the fail count has exceeding a maximum value (e.g., of three consecutive fails). If the fail count exceeds the maximum value, the controller 144 proceeds to step 326 to determine that the test is failed. However, if the fail count does not exceed the maximum value, the controller 144 may return to start such that the test can be repeated to verify that the failed test is associated with a consistent malfunction and/or loss of performance of the HVAC system 100 in the test mode.

At step 326, the controller 144 may determine test results 156 with a failing indication 158 and a maintenance request 160 associated with components which may have failed in the type of test performed. For instance, if the cooling mode test failed, the maintenance request 160 may indicate that service is needed associated with a loss of charge and/or a malfunction of one or more of the compressor 106, fan 110, and blower 130. If the heating mode test failed, the request 160 may indicate that service is needed associated with operation of the heating element 118 and/or blower 130. At step 318, the test results 156 may be displayed on an interface of the thermostat 136 (i.e., to inform user(s) that the test is failed and system maintenance is needed prior to the start of an anticipated change in weather conditions). At step 320, the test results 156 may be provided to the third party 162. When the test results 156 indicate that service is needed, the third party 162 may proactively schedule this maintenance and/or obtain materials needed for the anticipated maintenance, thereby allowing the third party 162 to preemptively repair the HVAC system 100 and reduce or eliminate downtimes of the HVAC system 100.

Modifications, additions, or omissions may be made to method 300 depicted in FIG. 3. Method 300 may include more, fewer, or other steps. For example, steps may be performed in parallel or in any suitable order. While at times discussed as controller 144, HVAC system 100, or components thereof performing the steps, any suitable HVAC system or components of the HVAC system may perform one or more steps of the method 300.

Example Controller

FIG. 4 is a schematic diagram of an embodiment of the controller 144. The controller 144 includes a processor 402, a memory 404, and an input/output (I/O) interface 406.

The processor 402 includes one or more processors operably coupled to the memory 404. The processor 402 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 404 and controls the operation of HVAC system 100. The processor 402 may be a programmable logic device, a microcontroller, a microprocessor, or any suitable combination of the preceding. The processor 402 is communicatively coupled to and in signal communication with the memory 404. The one or more processors are configured to process data and may be implemented in hardware or software. For example, the processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory 404 and executes them by directing the coordinated operations of the ALU, registers, and other components. The processor 402 may include other hardware and software that operates to process information, control the HVAC system 100, and perform any of the functions described herein (e.g., with respect to FIG. 3). The processor 402 is not limited to a single processing device and may encompass multiple processing devices. Similarly, the controller 144 is not limited to a single controller but may encompass multiple controllers.

The memory 404 includes one or more disks, tape drives, or solid-state drives, and may be used as an over-flow data storage device, to store programs when such programs are selected for execution, and to store instructions and data that are read during program execution. The memory 404 may be volatile or non-volatile and may include ROM, RAM, ternary content-addressable memory (TCAM), dynamic random-access memory (DRAM), and static random-access memory (SRAM). The memory 404 is operable (e.g., or configured) to store measured outdoor temperatures 146, occupancy 148 of the conditioned space, weather forecast information 150, system profile 152, test results 154, thresholds 408 (i.e., including any of the threshold values, predefined time period, maximum values, and/or minimum values described above with respect to FIGS. 1-3), a fail counter 410 (e.g., for maintaining the fail count associated with steps 314, 322, and 324 of FIG. 3), and/or any other logic and/or instructions for performing the function described in this disclosure.

The I/O interface 406 is configured to communicate data and signals with other devices. For example, the I/O interface 406 may be configured to communicate electrical signals with components of the HVAC system 100 including the compressor 106, fan 110, expansion device 114, heating element 118, sensors 134*a-d*, blower 130, and thermostat(s) 136. The I/O interface may provide and/or receive, for example, compressor speed signals blower speed signals, temperature signals, relative humidity signals, thermostat calls, temperature setpoints, environmental conditions, and an operating mode status for the HVAC system 100 and send electrical signals to the components of the HVAC system 100. The I/O interface 406 may include ports or terminals for establishing signal communications between the controller 144 and other devices. The I/O interface 406 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system, the HVAC system comprising:

an evaporator configured, when the HVAC system is operating in a cooling mode, to cool a flow of air provided to a space; and a heating element configured, when the HVAC system is operating in a heating mode, to heat the flow of air provided to the space;

a controller configured to:

receive weather forecast information comprising anticipated future outdoor temperatures;

determine, based at least in part on the weather forecast information, that test-initiation criteria are satisfied for testing operation of the HVAC system in the cooling mode, the test-initiation criteria corresponding to an anticipated future need for operation of the HVAC system in the cooling mode within a predefined time interval;

in response to determining that the test-initiation criteria are satisfied, determine that current weather conditions are suitable for operating the HVAC system in the cooling mode for a test time period;

in response to determining that that the current weather conditions are suitable for operating the HVAC system in the cooling mode for the test time period, cause the HVAC system to operate in the cooling mode for the test time period;

following operation of the HVAC system in the cooling mode for the test time period, determine whether a predefined decrease in an indoor air temperature is achieved;

in response to determining that the predefined decrease in the indoor air temperature is achieved, determine that a cooling test passed; and in response to determining that the predefined decrease in the indoor air temperature is not achieved:

determine that the cooling test failed; and provide an indication that the cooling test failed for display.

2. The HVAC system of claim 1, the controller further configured to determine that the test-initiation criteria are satisfied by determining, based on the received weather forecast information, that an outdoor temperature is anticipated to exceed a threshold value within the predefined time interval.

3. The HVAC system of claim 1, the controller further configured to:

during a period of time prior to causing the HVAC system to operate in the cooling mode, determine a system profile for the HVAC system, the system profile comprising historic usage information of the HVAC system, wherein the historic usage information comprises an average outdoor temperature at or above which a user requests operation of the HVAC system in the cooling mode; and determine that the test-initiation criteria are satisfied by determining, based on the received weather forecast information, that an outdoor temperature is anticipated to exceed the average outdoor temperature within the predefined time interval.

4. The HVAC system of claim 1, the controller further configured to:

in response to determining that that current weather conditions are suitable for operating the HVAC system in the cooling mode for the test time period, cause display of a test announcement on an interface of a thermostat coupled to the controller; and prior to causing the HVAC system to operate in the cooling mode for the test time period, receive a confirmation input on an interface of the thermostat to allow operation of the HVAC system in the cooling mode for the test time period.

5. The HVAC system of claim 1, the controller further configured to determine that current weather conditions are suitable for operating the HVAC system in the cooling mode for the test time period by determining that an outdoor temperature is greater than a minimum temperature value.

6. The HVAC system of claim 1, further comprising:

an occupancy sensor configured to measure whether an individual is located within the space; and the controller communicatively coupled to the occupancy sensor, the controller further configured to:

prior to causing the HVAC system to operate in the cooling mode, determine an occupancy of the space based at least in part on the measure of whether the individual is located in the space; and determine that the determined occupancy is less than a threshold value.

7. The HVAC system of claim 1, the controller further configured to:

in response to determining that the cooling test failed, determine a number of times the cooling test has consecutively failed; and in response to determining the number of times the cooling test has consecutively failed is greater than a threshold value, provide the indication that the cooling test failed for display.

8. The HVAC system of claim 1, the controller further configured, in response to determining that the predefined decrease in the indoor air temperature is not achieved, to automatically provide the indication that the cooling test failed and a request for service of the HVAC system to a third party associated with providing maintenance to the HVAC system.

9. A heating, ventilation, and air conditioning (HVAC) system, the HVAC system comprising:

an evaporator configured, when the HVAC system is operating in a cooling mode, to cool a flow of air provided to a space; and a heating element configured, when the HVAC system is operating in a heating mode, to heat the flow of air provided to the space;

a controller configured to:

receive weather forecast information comprising anticipated future outdoor temperatures;

determine, based at least in part on the weather forecast information, that test-initiation criteria are satisfied for testing operation of the HVAC system in the heating mode, the test-initiation criteria corresponding to an anticipated future need for operation of the HVAC system in the heating mode within a predefined time interval;

in response to determining that the test-initiation criteria are satisfied, cause the HVAC system to operate in the heating mode for the test time period;

following operation of the HVAC system in the heating mode for the test time period, determine whether a predefined increase in an indoor air temperature is achieved;

in response to determining that the predefined increase in the indoor air temperature is achieved, determine that a heating test passed; and in response to determining that the predefined increase in the indoor air temperature is not achieved:

determine that the heating test failed; and provide for display an indication that the heating test failed.

10. The HVAC system of claim 9, the controller further configured to determine that the test-initiation criteria are satisfied by determining, based on the received weather forecast information, that an outdoor temperature is anticipated to be less than a threshold value within the predefined time interval.

11. The HVAC system of claim 9, the controller further configured to:

during a period of time prior to causing the HVAC system to operate in the heating mode, determine a system profile for the HVAC system, the system profile comprising historic usage information of the HVAC system, wherein the historic usage information comprises an average outdoor temperature at or below which a user requests operation of the HVAC system in the heating mode; and determine that the test-initiation criteria are satisfied by determining, based on the received weather forecast information, that an outdoor temperature is anticipated to be less than the average outdoor temperature within the predefined time interval.

12. The HVAC system of claim 9, the controller further configured to:

in response to determining that the test-initiation criteria are satisfied, cause display of a test announcement on an interface of a thermostat coupled to the controller; and prior to causing the HVAC system to operate in the heating mode for the test time period, receive a confirmation input on an interface of the thermostat to allow operation of the HVAC system in the heating mode for the test time period.

13. The HVAC system of claim 9, the controller further configured to, prior to causing the HVAC system to operate in the heating mode for the test time period, determine that current weather conditions are suitable for operating the HVAC system in the heating mode for the test time period by determining that an outdoor temperature is less than a threshold temperature value.

14. The HVAC system of claim 9, further comprising:

an occupancy sensor configured to measure whether an individual is located within the space; and the controller communicatively coupled to the occupancy sensor, the controller further configured to:

prior to causing the HVAC system to operate in the heating mode, determine an occupancy of the space based at least in part on the measure of whether the individual is located in the space; and determine that the determined occupancy is less than a threshold value.

15. The HVAC system of claim 9, the controller further configured to:

in response to determining that the heating test failed, determine a number of times the heating test has consecutively failed; and in response to determining the number of times the heating test has consecutively failed is greater than a threshold value, provide the indication that the heating test failed for display.

16. The HVAC system of claim 9, the controller further configured, in response to determining that the predefined increase in the indoor air temperature is not achieved, to automatically provide the indication that the heating test failed and a request for service of the HVAC system to a third party associated with providing maintenance to the HVAC system.

17. A method of operating a heating, ventilation, and air conditioning (HVAC) system, the method comprising, by a controller of the HVAC system:

receiving weather forecast information comprising anticipated future outdoor temperatures;

determining, based at least in part on the weather forecast information, that test-initiation criteria are satisfied for testing operation of the HVAC system in a test mode, wherein the test mode corresponds to a heating mode when the HVAC system is currently operating in a cooling mode and the test mode corresponds to the cooling mode when the HVAC system is currently operating in the heating mode, wherein the test-initiation criteria correspond to an anticipated future need for operation of the HVAC system in the test mode within a predefined time interval;

in response to determining that the test-initiation criteria are satisfied, determining that current weather conditions are suitable for operating the HVAC system in the test mode;

in response to determining that that the current weather conditions are suitable for operating the HVAC system in the test mode, causing the HVAC system to operate in the test mode for a test time period;

following operation of the HVAC system in the test mode for the test time period, determining whether a predefined change in an indoor air temperature is achieved;

in response to determining that the predefined change in the indoor air temperature is achieved, determining that a test passed; and in response to determining that the predefined change in the indoor air temperature is not achieved:

determining that the test failed; and providing an indication that the test failed for display.

18. The method of claim 17, further comprising:

during a period of time prior to causing the HVAC system to operate in the test mode, determining a system profile for the HVAC system, the system profile comprising historic usage information of the HVAC system, wherein the historic usage information comprises an average outdoor temperature associated with a user request to operate the HVAC system in the test mode; and determining that the test-initiation criteria are satisfied by determining, based on the received weather forecast information, that an outdoor temperature is:

anticipated to exceed the average outdoor temperature within the predefined time interval, when the test mode is the cooling mode; and anticipated to be below the average outdoor temperature within the predefined time interval, when the test mode is the heating mode.

19. The method of claim 17, further comprising:

prior to causing the HVAC system to operate in the test mode, determining an occupancy of the space, the occupancy corresponding to a number of people within the space; and determining that the occupancy is less than a threshold value.

20. The method of claim 17, further comprising, in response to determining that the predefined change in the indoor air temperature is not achieved, automatically providing the indication that the test failed and a request for service of the HVAC system to a third party associated with providing maintenance to the HVAC system.

* * * * *